United States Patent [19]

Babitzka et al.

[11] Patent Number: 4,466,390

[45] Date of Patent: Aug. 21, 1984

[54] ELECTRO-HYDRAULIC VALVE CONTROL SYSTEM FOR INTERNAL COMBUSTION ENGINE VALVES

[75] Inventors: Rudolf Babitzka, Kirchberg; Wilhelm Polach, Möglingen; Walter Schlagmüller, Schwieberdingen, all of Fed. Rep. of Germany

[73] Assignee: Robert Bosch GmbH, Stuttgart, Fed. Rep. of Germany

[21] Appl. No.: 416,346

[22] Filed: Sep. 9, 1982

[30] Foreign Application Priority Data

Sep. 9, 1981 [DE] Fed. Rep. of Germany ..... 3135650

[51] Int. Cl.[3] ..... F01L 1/34

[52] U.S. Cl. ..... 123/90.16; 123/90.12

[58] Field of Search ..... 123/90.15, 90.16, 90.12

[56] References Cited

U.S. PATENT DOCUMENTS 4,153,016 5/1979 Hausknecht ..... 123/90.16 X
4,218,995 8/1980 Aoyama ..... 123/90.16 X

FOREIGN PATENT DOCUMENTS 2907033 9/1980 Fed. Rep. of Germany ... 123/90.16
2926327 1/1981 Fed. Rep. of Germany .

*Primary Examiner*—William R. Cline

*Assistant Examiner*—Peggy A. Neils

*Attorney, Agent, or Firm*—Frishauf, Holtz, Goodman & Woodward

[57] ABSTRACT

Electric control of a hydraulic valve control system is obtained by providing hydraulic fluid to form a hydraulic plug between a cam follower in engagement with the camshaft of the engine and a valve stem (11), the hydraulic plug or hydraulic fluid being retained in a chamber which, under control of an electrically operated valve (20, 25; 38), can establish communication to a drain line (19, 47). For rapid movement, the valve can be clamped in closed position by a piezoelectric column (FIG. 1: 28) to prevent drainage, and, upon clamping release of the column, permit drainage, and hence release of the "hydraulic plug", and thus provide for closing action of the valve under operation of a valve spring (13) to thereby shorten the open-time of the valve (FIG. 2, compare curves 31, 32, 33). A spool slider valve can also be used, the position of which is controlled by a pilot valve (FIG. 3: 40, 57, 64) in which a piezoelectric element moves a piston (57) which establishes pressure differential on a slider spool (42) which, respectively, connects the hydraulic plug to a drain (47) or prevents drainage, thus transferring movement of a cam (3) from the camshaft to the cam follower (4) and hence to the valve stem (11).

10 Claims, 4 Drawing Figures

ELECTRO-HYDRAULIC VALVE CONTROL SYSTEM FOR INTERNAL COMBUSTION ENGINE VALVES

Reference to related applications, assigned to the assignee of the present application: U.S. Ser. No. 311,677, filed Oct. 15, 1981, BABITZKA et al; U.S. Ser. No. 415,458, filed Sept. 7, 1982, BABITZKA et al; German Disclosure Document No. DE-OS 29 26 327.

The present invention relates to electro-hydraulic control of valves for an internal combustion engine, and more particularly to control the open-time of cylinder inlet and outlet valves of piston-type internal combustion engines.

BACKGROUND

Controlling the valves of internal combustion engines by mechanical-hydraulic means has been previously proposed—see German Patent Disclosure Document No. DE-OS 29 26 327. A camshaft is used which controls the valves and, interposed in the transmission path between a cam follower in contact with the camshaft and the valve itself is a hydraulic cushion, or a fluid cushion or plug, which is provided by a hydraulic pressure source. It is possible to change the valve open and closing times to match the valves to specific operating conditions of the internal combustion (IC) engine by including a drain valve in the hydraulic system which includes the cushion so that, even though the mechanical cam may be in a position tending to hold the valve open, hydraulic transmission fluid has been drained or bypassed, so that the valve can return to closed position, for example under influence of a spring, in advance of the rotation of the cam to "valve-closed" position. The operation of the valve, thus, can be matched to conditions of the engine, for example to lower fuel consumption by dropping the choking losses arising in passage of gases around the valves, or to decrease valve timing overlap in various cylinders of a multi-cylinder engine at low speeds. Additionally, starting of IC engines can be improved.

The control system which has been proposed utilizes a rotary slider, driven from the camshaft of the engine, and so arranged that its angular position with respect to a predetermined angle or reference position of the camshaft can be changed within some limits. The rotary slider then controls the hydraulic system which can decrease the open-time commanded by the mechanically driven camshaft-cam follower arrangement, opening the valve. Thus, and upon decrease of the open-time, better operation of the engine can be obtained.

Electronic control of the timing of the open-time of the valve would be highly desirable; electronic control can utilize sensed signals which can be processed in accordance with operating characteristics of the engine. It has not been possible to utilize the advantages of electronic control without excessive requirements of apparatus and the like which transfer the processed electrical signals to output elements, such as servo positioning elements operating on the valves directly. The precision with which the valves can be controlled, for example in accordance with a desired position of the rotary slider previously described, will depend on the precision of the transfer system. This requires extremely close tolerances in manufacture, and even minor tolerance differences will introduce transfer errors. Such transmission errors are practically unavoidable in mass production apparatus, and calibration or adjustment to compensate for tolerances is difficult, time-consuming, and not always reliable. Independent, variable control of the valves of respective separate cylinders of a multi-cylinder IC engine, and possible disconnection of cylinders from the power train, cannot be carried out by the known system.

THE INVENTION

It is an object to provide an electrically controlled valve operating mechanism or system, which is simple, reliable, and uses available apparatus which can readily be incorporated in commercial IC engines.

Briefly, a camshaft has a cam follower in contact therewith which, in turn, is coupled through a mechanical-hydraulic link to the valve or the valve stem of one of the valves of the internal combustion (IC) engine. The mechanical hydraulic coupling includes a supply of pressurized hydraulic fluid which provides a plug or cushion of pressurized fluid between the cam follower and the valve element or valve stem, which can be formed or attached to a piston, to transfer movement of the cam follower to the valve stem. In accordance with the invention, an electrically operated valve is provided connected to a drain line to, selectively, permit drainage of the pressurized hydraulic fluid, and thereby permit return of the IC engine valve to a predetermined position, for example under spring pressure, such as closed position, regardless of the then pertaining position of the cam engaging the cam follower. Thus, by draining the hydraulic fluid or draining the hydraulic plug between the cam follower and the valve, control of the valve position can be obtained independently of the position of the cam follower.

In accordance with a feature of the invention, the drain valve is controlled by a piezoelectric positioning element. Such piezoelectric positioning elements have extremely rapid response and, although the path of travel of the positioning element may be small, the effectiveness and reliability of operation thereof is excellent. For example, the piezoelectric element may be placed in position to clamp a strip element connected, for example, to the drain valve, in position, change of state of the energization of the piezoelectric element releasing the clamp and permitting the drain valve element to move under hydraulic and/or spring pressure.

In accordance with another feature of the invention, a piezoelectric positioning element can be used to control the position of a pilot valve piston which has a piston cross section large with respect to the piston of the controlled valve itself, so that the small excursion of the piezoelectric element which, however, is carried out under conditions of substantial power, is amplified to a substantially larger excursion by the controlled valve.

The control system in accordance with the present invention has the advantage that extremely short and variable response times can be obtained, so that the open-duration of the valve can be accurately controlled. The overall control time of operation of the valve, of course, is controlled by the camshaft; with low cost and at low material requirements, however, overriding control is obtainable, and permits independent variable control of the valve of respective cylinders of a multi-cylinder IC engine and, for example, can permit continued open-position of valves without interfering in any way with the operation of the camshaft and the cam followers to thereby, electrically, control disabling, for example, the power supply function of any one or more specific cylinders.

The piezoelectric control permits particularly short response times; utilizing only a single piezoelectric positioning element for two valve control units—which is entirely feasible—additionally simplifies the structure.

DRAWINGS

Figure 4:
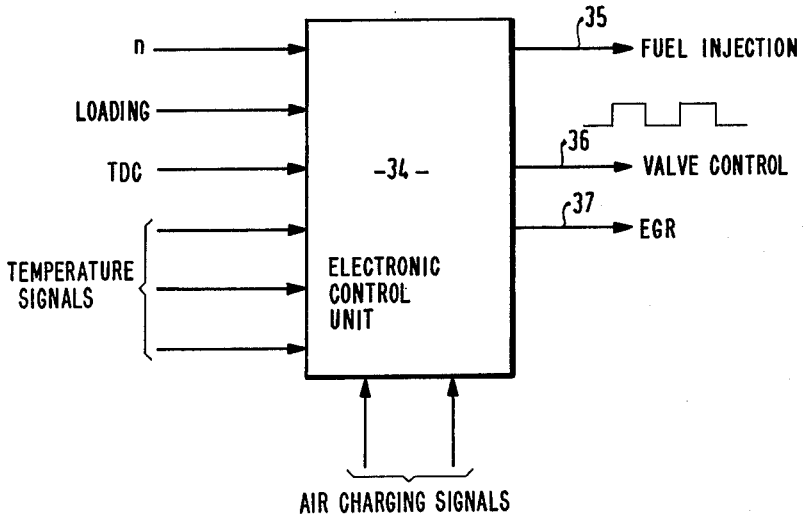

and FIG. 4 is a schematic representation of an electronic control unit to control the piezoelectric positioning elements.

An internal combustion (IC) engine 1 has a camshaft 2 with cams 3, in standard construction. The cams 3 are contacted by a cam follower 4 which is constructed in form of a piston, slidable within a control cylinder 5. The piston 4, forming the cam follower, is hollow to define an internal hollow space 6 within which the helical compression spring 7 is received. The cylinder 5 is subdivided by an internal projection 8, for example solid with the cylinder head 1, or in form of a snap ring seated in a groove formed in the piston. A second piston 9 is located in the cylinder 5 in the portion below the stop ring 8—with respect to FIG. 1. The piston 9 is formed with a recess at its face directed towards the piston 4 to form a seat for the other end of the helical compression spring 7. Piston 9 is coupled to an inlet valve of the IC engine 1. The piston 9 also is formed with a hollow recess 12 therein within which a helical compression spring 13 is seated. The helical compression spring 13 is seated at its other end in the bottom 14 of the cylinder 5. The compression spring 13 surrounds the stem of the inlet valve 11.

A hydraulic line 15 is connected to the cylinder 5 just above the ring 8. The line 15 is connected to a hydraulic pressure supply line 16, which is connected via a check valve 17 to a source of pressurized hydraulic fluid. A return line 19 branches off from the duct 15.

In accordance with a feature of the invention, flow of hydraulic fluid can be controlled by a valve slider 20 movable to close off the return or drain line 19. The slider 20 has a flange 21 which is movable in an enlargement 22 within the bore forming duct 15. The longitudinal path of the slider 20 is limited by the size of the enlargement 22 within which the flange 21 can move. Thus, the position of the valve element 20 with respect to open and closed position relative to the drain line 19 is limited. A helical compression spring 23 is located in the duct 15, also within a somewhat enlarged portion 24, and biassed to tend to move the valve element 20 in a position to close the return line 19.

In accordance with a feature of the invention, the slider 20 has a clamping strip 25 attached thereto. Clamping strip 25 passes through the center of the helical spring 23 and terminates just beyond an anvil 26. A clamping plunger 27 is located opposite anvil 26. Clamping plunger 27 is secured to the end of a piezoelectric column 28. Piezoelectric column 28 is built up of a plurality of stacked piezoelectric disks **28*a*. The column 28 is securely seated in the housing of the IC engine with the end remote from the clamping plunger 27. An electrical connection 29 extends into the column 26** in order to apply a supply voltage for the piezoelectric disks therein.

Figure 1:
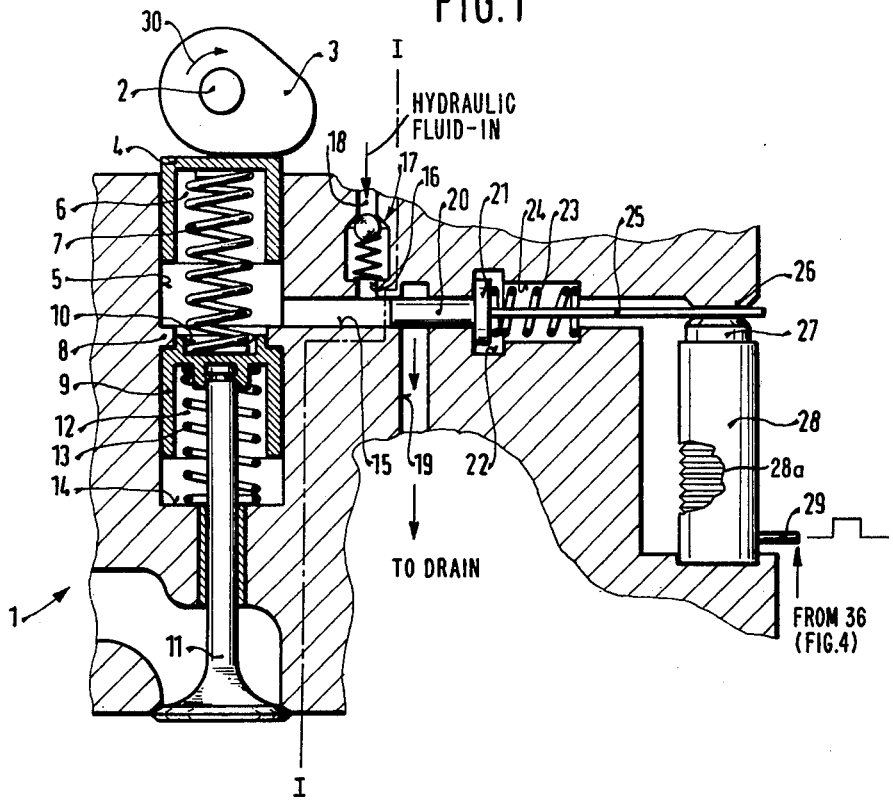
FIG. 1 is a fragmentary vertical cross-sectional view through a valve portion of the cylinder head of an internal combustion engine, illustrating a piezoelectrically controlled valve system in cross section.

Operation: Let it be assumed that, in quiescent position, the column 28 is deenergized and that, in this position, the post or plunger 27 presses the clamping strip 25 against the anvil 26. In this position, the valve slider 20 will be located as shown in FIG. 1, that is, the drain line 19 is closed off from communication with duct 15.

Hydraulic pressurized fluid, which is free from gas bubbles and the like, is introduced through inlet line 18, the check valve 17, into duct 15 to completely fill the space 6 beneath the cam follower piston 4, and the duct 15 and the space up to valve 17 completely and without compressive gas therein. Mechanical movement of the cam 3, rotating in the direction of the arrow 30, will be transmitted through the piston 4, and hydraulic within the piston 4 and the space which will be closed off by the check valve 17 and by the slider valve 20. A plug of hydraulic fluid will, thus, be located within these spaces, and mechanical movement from the cam 3 will be directly transmitted via the cam follower 4, the hydraulic pressure fluid, and piston 9, directly to the inlet valve 11. The valve will open. The valve slider 20 cannot move to the right—with respect to FIG. 1—since it is clamped in position between the anvil 26 and the plunger 27.

Upon application of a control voltage to the piezoelectric column 28, the column will contract longitudinally, thus releasing the clamping connection with respect to the valve slider 20. The valve slider 20 can now move to the right under hydraulic pressure applied thereto, and counter the spring 23, thus opening the drain line 19. Piston 4 continues to apply pressure and to push fluid out of the drain line 19. Consequently, the inlet valve 11 will close under the operating force of the spring 13, e.g. at time T1, T2, before bottom dead center (BDC).

Figure 2:
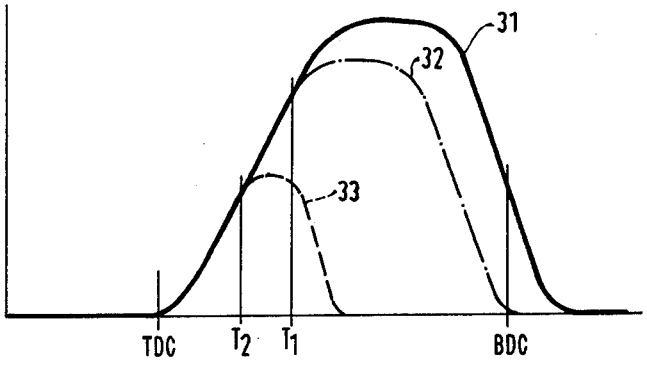
FIG. 2 is a graph of valve excursion path (ordinate) with respect to time (abscissa), which is also proportional to crankshaft angle of the IC engine.

Curves of excursion of the valve 11 for different operating conditions are shown in FIG. 2. Curve 31 is the operating movement controlled only by the cam 3 on the camshaft 2, that is, if the piezoelectric column 28 is never energized. Curves 32, 33 illustrate the movement for shortened valve-open time modes. As referred to above, losses due to choking effects at the edges of the inlet valve 11, cross-over of operation of valves in multi-cylinder engines and the like may be reduced, particularly at slow engine speeds. If the slider 20 is so controlled that movement is released already at the beginning of rotation of the cam 3 to depress cam follower 4, valve 11 will not open at all, since spring 13 will hold it in closed position. This mode of operation is important if cylinders of a multi-cylinder engine are to be disconnected. Economical operation of an IC engine 1 can also be obtained by filling the respective cylinders only partially; for example, at light loading, only half of the cylinders need be filled with the normal volume of fuel-air mixture, or combustion air fill, and a further portion, for example the other half of the cylinders, is filled only partially. The interplay between variable valve controls, variable fuel injection, and possibly also variable exhaust gas recirculation (EGR), can be optimized with an electronic control unit 34 (FIG. 4), supplying control signals to the piezoelectric column 28.

Electronic control: The control unit illustrated in FIG. 4 is only schematically shown, to illustrate examples of control possibilities. An electronic signal processing unit has inputs coupled to respective sensors and receives input signals representative of engine speed n, loading on the engine, for example derived from a potentiometer coupled to a control pedal, time of position of top dead center (TDC) of a reference piston with respect to rotation of the crankshaft, oil, water, and ambient air temperature, type of fuel, ambient air pressure, or turbo-charging air pressure. The unit 34 includes stored data representative of engine operating characteristics in the light of various variable input parameters, and provides output signals which, for example, control by line 35 a fuel injection system by controlling the initiation and termination of fuel injection, exhaust gas recirculation (line 37) by controlling an EGR valve, and, in accordance with a feature of the invention, additionally providing an output signal (line 36) to control the piezoelectric column which, in turn, controls the valves of the IC engine.

Figure 3:
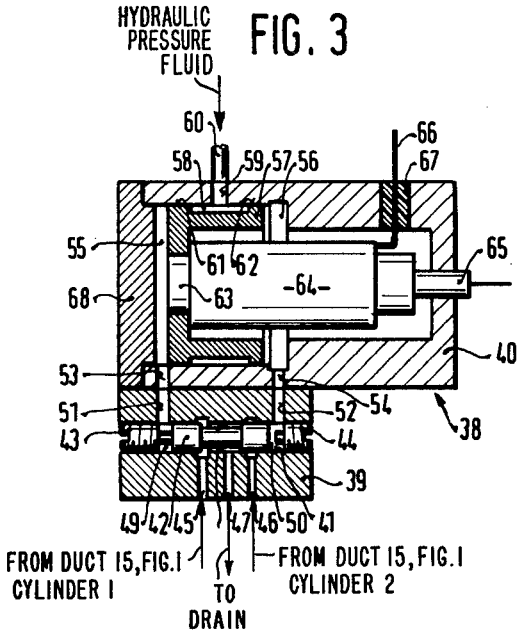
FIG. 3 is a longitudinal sectional view through a piezoelectric positioning element illustrating another embodiment.

Embodiment of FIG. 3: A piezoelectric control block is used rather than the valve slider 20. The piezoelectric control block 38 has a slider housing 39 and a driver or pilot valve housing 40. The slider or valve housing 39 has a bore 41 within which a valve spool 42 is slidably received. Bore 41 is closed off at both ends by threaded plugs 43, 44 which can be selectively positioned within the bore 41 to limit or control the excursion of the valve slider 42. Ducts 45, 46 within housing 39 are connected, respectively, to lines 15 of two valve units which, respectively, are similar to those shown in FIG. 1 and include the cam 3, camshaft 2, cam follower 4, and associated valve operating piston-cylinder and spring elements. In other words, all structures to the left of line I—I in FIG. 1 are duplicated, and the lines 15 of each one of these valve elements are connected to the respective ducts 45, 46. A further duct 47 is connected to a drain line 19. Valve slider 42 is formed with a cylindrical recess 48. The terminations of the ducts 45, 46 are so located with respect to the slider 42 that, in the respective end positions of the spool or slider 42, either the one or the other of the ducts 45, 46 is connected to the drain duct 47. The position shown in FIG. 3 illustrates connection between the ducts 45 and 47 by the valve spool 42. Duct 46, however, is closed.

The valve which has its line 15 connected to the duct 45 and will not open even though the cam 3 of the respective valve would rotate in a position to depress the cam follower piston 4. In contrast, the valve which has its line 15 connected to the duct 46 will open, since the hydraulic pressure fluid 18 cannot escape or drain, and the movement caused by the cam 3 is transmitted via the cam follower 4 to the piston 9 and hence to the valve 11.

The position of the spool slider 42 in the housing 39 is controlled by a pilot valve which includes two pressure chambers 49, 50 opposite the facing ends of the spool 42. The pressure chambers 49, 50 are connected over respective ducts 51, 52 formed in the housing 39 with ducts 53, 54 in the housing of the pilot or driver valve 40. Ducts 53, 54 are connected to pressure chambers 55, 56 within housing 40. The pressure chambers 55, 56 are located at respective sides of a piston 57, which is guided in the cylinder defined by the chambers 55, 56. Piston 57 is formed with a cylindrical recess 58. A duct 59 terminates in the region of the recess 58. Duct 59 extending through the housing 40, is connected to a source of pressurized hydraulic fluid, for example to the oil pressure circuit of the IC engine 1 by a line 60. The pressure chambers 55, 56 can communicate via throttling gaps 61, 62; the throttling gaps 61, 62 also provide communication with the pressure connections 59, 60.

In accordance with a feature of the invention, piston 57 is secured to a pin 63 which is located at one end of a piezoelectric column 64, formed of stacked piezoelectric disks. The other end of the column 64 is extended by a post 65 which is securely connected to the housing 40. An electrical connection extends from the column 64 through a seal 67 to the electronic control unit 34. The cylinder 55, 56 is closed off by a cover 68.

Operation, FIG. 3: If the column 64 is deenergized, valve slider 42 is held in a position shown in FIG. 3, that is, in engagement with the left plug 43. Upon application of a voltage to the piezoelectric column 64, column 64 will expand and drive the piston 57 towards the left—with reference to FIG. 3. The pressure in chamber 55, and hence the pressure in chamber 49, will rise, whereas the pressure in chamber 56, and hence in chamber 50, will drop. To compensate for the pressure differential, slider 42 will move towards the right to engage the bolt 44, closing off duct 45 and opening the duct 46 to the drain line 47.

The piezohydraulic control unit 38 thus can be used to control two valves. If, for example, the electrical control of the piezo element 64 should fail, the IC engine can still be operated at half loading, that is, alternating, one cylinder can carry full load and the other no load whatsoever, since its valves will not open.

The piston 57 has a substantially greater diameter than the end faces of the pistons formed by the spool 42; preferably, the hydraulic transformation ratio of piston 57 diameter to slider spool 42 diameter is greater than the ratio of slider path of the spool 42 to the excursion or path of the piezoelectric driving element 64. The length of the path of the slider can be adjusted by properly positioning the threaded plugs 43, 44.

To reduce temperature effects, the thermal coefficient of expansion of the piston 57, preferably, is selected to be greater than the thermal coefficient of expansion of the material forming the driver housing 40.

Temperature effects, thus, are compensated by making the path length of the slider spool 42 less than that which would, theoretically, obtain if the hydraulic transformation ratio were 1:1. The throttle gaps 61, 62 likewise provide for compensation since the fluid in the pressure chambers 55, 56 at the two sides of the piston 57 can leak. The throttle gaps 61, 62 connect not only the pressure chambers 55, 56 with respect to each other but also with the pressure connection formed by chamber 59 and duct 60. If one of the pistons connected to the respective ducts 45, 46 in the valve housing 39 is to be preferred, a biassing spring can be placed in the bore within which the slider spool 42 operates to provide a biassing force for the slider spool.

Various changes and modifications may be made, and features described in connection with any one of the embodiments may be used with any of the others, within the scope of the inventive concept.

We claim:

1. Valve control system for an internal combustion engine having a camshaft (2, 3);

a valve stem (11);

a cam follower (4) in engagement with the camshaft;

a mechanical-hydraulic coupling means coupling the valve stem and the cam follower, including a hydraulic pressure line receiving hydraulic fluid, and a hydraulic drain line (19);

means (5, 6, 9) for providing hydraulic coupling between the valve stem and the cam follower;

and valve means to selectively permit or inhibit flow of hydraulic fluid from the pressure line to the drain line and thus establish a hydraulic coupling between the valve stem and the cam follower or, selectively, release said coupling upon permitting hydraulic fluid to drain to the drain line, wherein, in accordance with the invention, said valve means comprises an electrically controlled valve (20, 38);

the electrically controlled valve includes a valve slider (20, 25);

and electrically controlled clamping means (26, 27, 28) are provided, positioned in clamping relation with respect to said valve slider to permit or inhibit sliding movement of said slider, selectively, in accordance with the state of energization of said electrically controlled clamping means.

2. System according to claim 1 wherein piezo-electrically controlled means (28, 64) are provided, controlling sliding operation of said valve slider (20, 25) and engageable therewith.

3. System according to claim 1, wherein said electrically controlled clamping means are located to have a clamping movement extending at essentially right angles with respect to the sliding movement of the valve slider.

4. System according to claim 1, wherein said electrically controlled clamping means comprises a piezoelectric positioning element (28).

5. System according to claim 4, wherein the piezoelectric positioning element includes a plurality of stacked piezoelectric disks forming a piezoelectric positioning column.

6. System according to claim 5, wherein the axis of said column extends approximately perpendicularly to the direction of sliding movement of the valve slider (20, 25).

7. System according to claim 3, wherein the valve slider comprises a valve element (20) and a strip-like extension element (25), said strip-like extension element being positioned for clamping engagement by the electrically controlled clamping means.

8. System according to claim 1, further including a housing;

and wherein the clamping means comprises a counter element or anvil (26) formed in the housing, the electrically controlled clamping means providing for clamping of the slider against said anvil.

9. System according to claim 7, further including a housing;

wherein the clamping means comprises a counter element or anvil (26) formed in the housing, the electrically controlled clamping means providing for clamping of said strip-like extension element against said anvil;

and wherein the electrically controlled clamping means includes a clamping plunger or post positioned to press said strip-like extension element against the anvil.

10. System according to claim 1, wherein said valve slider is positioned to open the drain line when in one position, and to close the drain line when in another position;

and said electrically controlled means engage said slider for holding the slider in valve-closed position when providing clamping pressure, but permitting opening movement of the slider under reaction of hydraulic force thereagainst, when in unclamped or released position, and thus permitting movement of the valve slider to open a fluid connection to the drain line.

* * * * *